US009609993B2

(12) United States Patent
Li

(10) Patent No.: US 9,609,993 B2
(45) Date of Patent: Apr. 4, 2017

(54) BUTTERFLY DUSTER

(71) Applicant: Casabella Holdings, LLC, Congers, NY (US)

(72) Inventor: Quan Li, Queens, NY (US)

(73) Assignee: Casabella Holdings, LLC, Congers, NY (US)

( * ) Notice: Subject to any disclaimer, the term of this patent is extended or adjusted under 35 U.S.C. 154(b) by 211 days.

(21) Appl. No.: 14/295,538

(22) Filed: Jun. 4, 2014

(65) Prior Publication Data

US 2015/0351604 A1 Dec. 10, 2015

(51) Int. Cl.

| | |
|---|---|
| ***A47L 13/258*** | (2006.01) |
| ***A47L 13/38*** | (2006.01) |
| ***B25G 3/38*** | (2006.01) |
| *A47L 13/255* | (2006.01) |
| *A47L 13/146* | (2006.01) |

(52) U.S. Cl.

CPC ..... *A47L 13/258* (2013.01); *A47L 13/38* (2013.01); *B25G 3/38* (2013.01); *A47L 13/146* (2013.01); *A47L 13/255* (2013.01)

(58) Field of Classification Search

CPC ..... A47L 13/14; A47L 13/146; A47L 13/20; A47L 13/24; A47L 13/254; A47L 13/255; A47L 13/256; A47L 13/257; A47L 13/258

USPC ... 15/147.1, 147.2, 119.1, 119.2, 228, 229.1, 15/229.6–229.9

See application file for complete search history.

(56) References Cited

U.S. PATENT DOCUMENTS

| | | | | |
|---|---|---|---|---|
| 1,178,069 A | | 4/1916 | Grant | |
| 2,730,744 A | * | 1/1956 | Vaugha | A47L 13/146 15/119.2 |
| 2,883,689 A | * | 4/1959 | Vosbikian | A47L 13/146 15/119.2 |
| 2,987,745 A | * | 6/1961 | Ballinger | A47L 13/255 15/144.2 |
| 3,224,025 A | | 12/1965 | Altrok | |
| 4,845,800 A | | 7/1989 | Pederson | |
| 5,864,914 A | | 2/1999 | Salmon | |
| 6,233,777 B1 | * | 5/2001 | Kresse | A47L 13/20 15/229.1 |
| 6,606,757 B2 | | 8/2003 | Vosbikian | |

(Continued)

FOREIGN PATENT DOCUMENTS

| | | | |
|---|---|---|---|
| CA | 2510032 | * | 7/2004 |
| EP | 1188406 | * | 3/2002 |

(Continued)

OTHER PUBLICATIONS

Partial machine translation of EP 1188406, Mar. 20, 2002.*

*Primary Examiner* — Mark Spisich
(74) *Attorney, Agent, or Firm* — Curtis, Mallet-Prevost, Colt & Mosie, LLP

(57) ABSTRACT

A butterfly duster is disclosed having a novel folding duster head. The wings of the duster head are opened and closed with a fork actuator arrangement that interacts with a gliding surface and retention walls on each wing to allow each half of the fork actuator to glide along the surface of each wing in a controlled and linear manner without the need for different materials between the wings and each gliding surface. Linear guides and linear guide slots provide further control of the fork actuator as it rides along a slide coupling while opening or closing the wings of the duster head.

20 Claims, 16 Drawing Sheets

(56) References Cited

U.S. PATENT DOCUMENTS

| | | | | |
|---|---|---|---|---|
| 6,854,911 | B2 | 2/2005 | Policicchio | |
| 7,469,441 | B2 | 12/2008 | Hirse | |
| 7,802,340 | B2 | 9/2010 | Knopow | |
| 8,225,452 | B2 | 7/2012 | Fischer | |
| 8,943,638 | B1 * | 2/2015 | Armaly, Jr. ..... | A47L 13/146 15/119.2 |
| 2002/0056167 | A1 * | 5/2002 | Ohm ..... | A47L 13/146 15/119.2 |
| 2008/0016634 | A1 | 1/2008 | Vosbikian | |
| 2008/0282489 | A1 | 11/2008 | Monahan | |
| 2010/0064466 | A1 | 3/2010 | Dingert | |

FOREIGN PATENT DOCUMENTS

| | | | |
|---|---|---|---|
| EP | 1413240 | * | 4/2004 |
| WO | 94/23635 | * | 10/1994 |

* cited by examiner

BUTTERFLY DUSTER

BACKGROUND OF THE INVENTION

1. Field of the Invention

This invention relates generally to cleaning devices, and more specifically to a butterfly duster that is well suited for many cleaning tasks.

2. Description of Related Art

The need to clean surfaces of dust, debris, and other unwanted material has been prevalent in society for thousands of years. Brooms, brushes, dusters, and various other cleaning implements have been applied to the task of cleaning away unwanted materials for thousands of years, and these implements continue to evolve with the use of modern materials and design techniques.

The feather duster, for example, came about as a use for turkey feathers rendered from turkey processing. In 1874 Susan Hibbard filed a patent application for an Improvement in Feather Dusters where she described cutting away the stem of a feather to make the feather more suitable for a feather duster due to its increased flexibility. In 1876, U.S. Pat. No. 177,939 was issued to Susan Hibbard. Modern materials have limited the usefulness of natural materials such as turkey feathers, but with the complexity of modern day life and related modern day conveniences, buildings and other manmade environments. the need for cleaning devices has also never been greater. Dusters, for example, while well suited for removing dust from planar surfaces such as tables, floors, and the like, often fail to offer the necessary structural attributes necessary to clean angled or spaced surfaces such as stair treads, chair rungs, baseboards, moldings, and the like. In addition, the duster has collected dust and debris, it must be moved to a location, such as an outdoor area, where it can be shaken and freed from entrapped dust and debris so as to be ready for the next cleaning job. While a simple task, oftentimes carrying the dust and debris laden duster any distance at all results in the undesired release of the same dust and debris that was just removed from the now clean area.

What is therefore needed is a duster that folds to allow for ease of transportation and storage in a way that prevents the undesired release of dust and debris. What is further needed is a duster that folds in a way that allows for cleaning of edges and other transitional and non-planar surfaces. What is further needed is a duster that folds for compact storage.

It is thus an object of the present invention to provide a butterfly duster that easily folds for retention of collected dust and debris. It is another object of the present invention to provide a butterfly duster that folds for compact storage. It is yet another object of the present invention to provide a butterfly duster that folds using a novel alignment mechanism. It is yet another object of the present invention to provide a butterfly duster that folds without the need to manufacture the duster from different sliding materials. It is another object of the present invention to provide a butterfly duster with a novel folding mechanism. It is still another object of the present invention to provide a butterfly duster with a novel cleaning pad and retention structure.

These and other objects of the present invention are not to be considered comprehensive or exhaustive, but rather, exemplary of objects that may be ascertained after reading this specification and claims with the accompanying drawings.

BRIEF SUMMARY OF THE INVENTION

In accordance with the present invention, there is provided a butterfly duster comprising a duster head comprising a first wing and a second wing; a wing hinge comprising a wing hinge body, a wing hinge joint and at least one wing hinge post for engaging with each wing of the duster head; a slide coupling hingably coupled to the wing hinge with a universal joint; a generally hollow fork actuator comprising a first fork half and a second fork half; wherein the slide coupling is disposed within the fork actuator; and wherein each wing further comprises a fork actuator gliding surface bounded by a first retention wall and a second retention wall in a configuration that allows each fork half of the fork actuator to glide along the surface of each wing in a controlled and linear manner without the need for different materials between the wings and each gliding surface.

The foregoing paragraph has been provided by way of introduction, and is not intended to limit the scope of the invention as described in this specification, claims and the attached drawings.

BRIEF DESCRIPTION OF THE DRAWINGS

The invention will be described by reference to the following drawings, in which like numerals refer to like elements, and in which.

Figure 1:
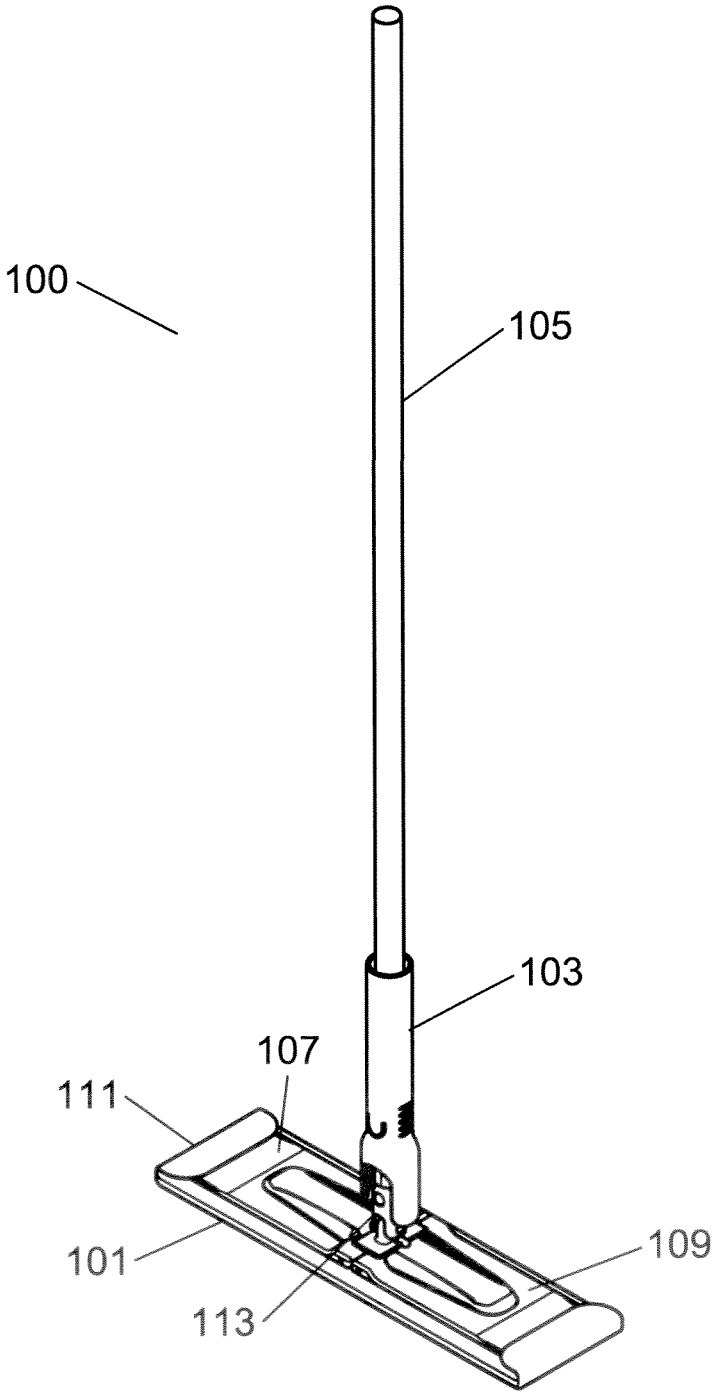
FIG. 1 is a perspective view of a butterfly duster of the present invention.

The attached figures depict various views of the butterfly duster in sufficient detail to allow one skilled in the art to make and use the present invention. These figures are exemplary, and depict a preferred embodiment; however, it will be understood that there is no intent to limit the invention to the embodiment depicted herein. On the contrary, the intent is to cover all alternatives, modifications, and equivalents as may be included within the spirit and scope of the invention as defined by this specification, claims and drawings.

DESCRIPTION OF THE PREFERRED EMBODIMENTS

A Butterfly Duster is described and depicted by way of this specification and the attached drawings.

For a general understanding of the present invention, reference is made to the drawings. In the drawings, like reference numerals have been used throughout to designate identical elements.

The Butterfly Duster of the present invention, as described and depicted herein, provides, among other things, a novel folding mechanism that allows for proper alignment and folding of the wings of the butterfly duster, and can be so constructed without the need or necessity for different materials to facilitate sliding of the surfaces while closing or opening.

FIG. 1 is a perspective view of the Butterfly Duster 100 according to one embodiment of the present invention. The butterfly duster may be made from any suitable rigid or semi-rigid material, for example, a plastic. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, wood, or other materials that may be suitably formed may also be used. The various components of the butterfly duster may be made by injection molding, blow molding, machining, extruding, forming, or the like. The various components are then assembled in accordance with the instructions and figures provided herein.

A duster head 101 comprising a first wing 107 and a second wing 109 can be seen. A fork actuator 103 with a slide coupling (see FIG. 9) slidably disposed within the generally hollow fork actuator can be seen. A pole 105 is mechanically coupled to the duster head 101, in some embodiments of the present invention by way of the slide coupling. In use, a cleaning sleeve 111 is attached to the duster head 101. The cleaning sleeve 111 may be made from a natural or synthetic fiber, for example, a polypropylene or polyester yarn or fiber. The wings 107 and 109 are mechanically coupled to allow for folding, and are in turn connected to the slide coupling and connected pole 105 by way of a universal joint 113 that allows for freedom of movement of the duster head 101.

Figure 2:
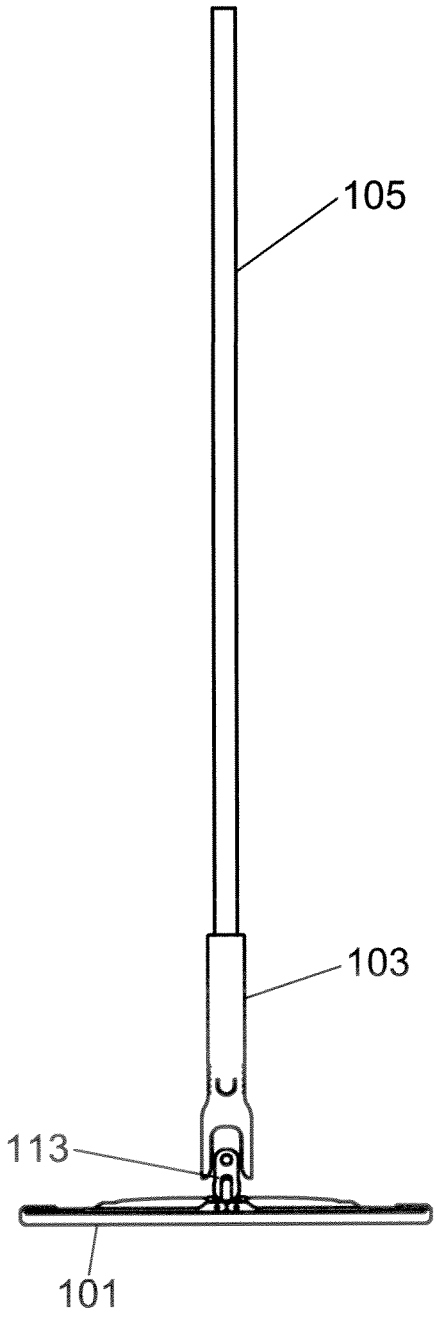
FIG. 2 is a plan view of the butterfly duster.
Figure 3:
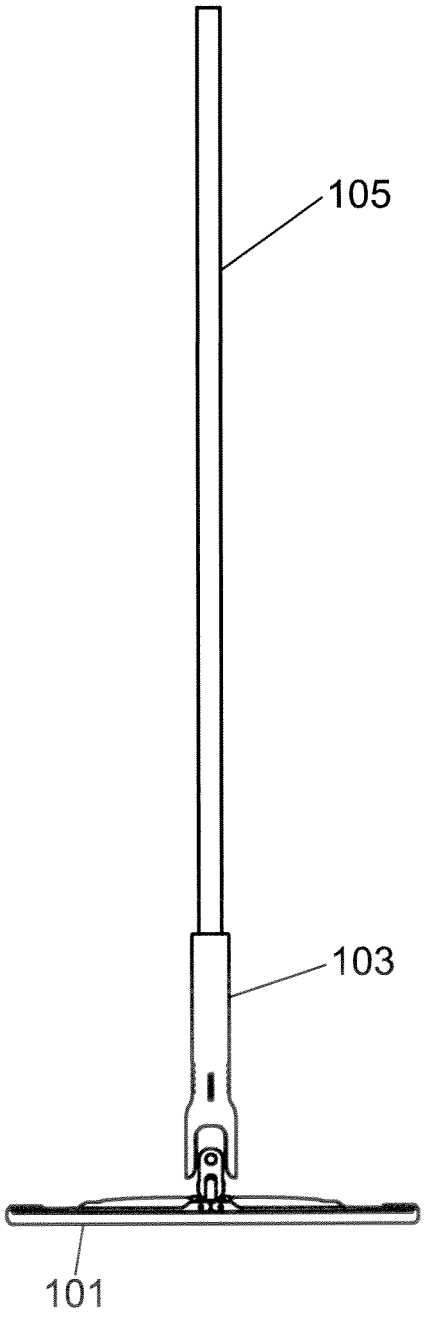
FIG. 3 is an opposite side plan view of the butterfly duster.

FIG. 2 is a plan view of the butterfly duster showing clearly the universal joint 113 and related structure of the butterfly duster. FIG. 3 is an opposite side plan view of the butterfly duster showing again the fork actuator 103 and the interaction of the fork actuator with the duster head 101 and related wings.

Figure 4:
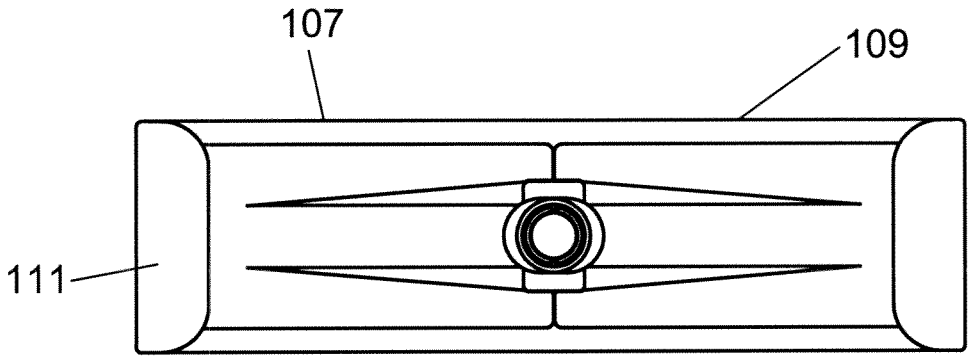
FIG. 4 is a top plan view of the butterfly duster head.

FIG. 4 is a top plan view of the butterfly duster head showing the first wing 107 and the second wing 109 and the cleaning sleeve 111 installed thereon.

Figure 5:
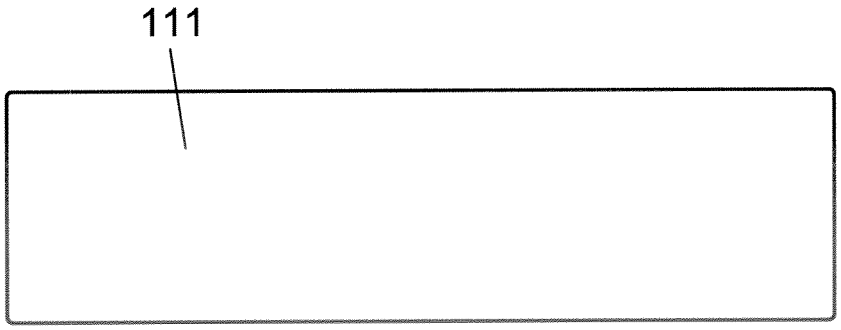
FIG. 5 is a bottom plan view of the butterfly duster head.

FIG. 5 is a bottom plan view of the butterfly duster head with a cleaning sleeve 111 installed thereon. As will be later described, the cleaning sleeve 111 may contain various and differing materials, fabrics, and cleaning features.

Figure 6:
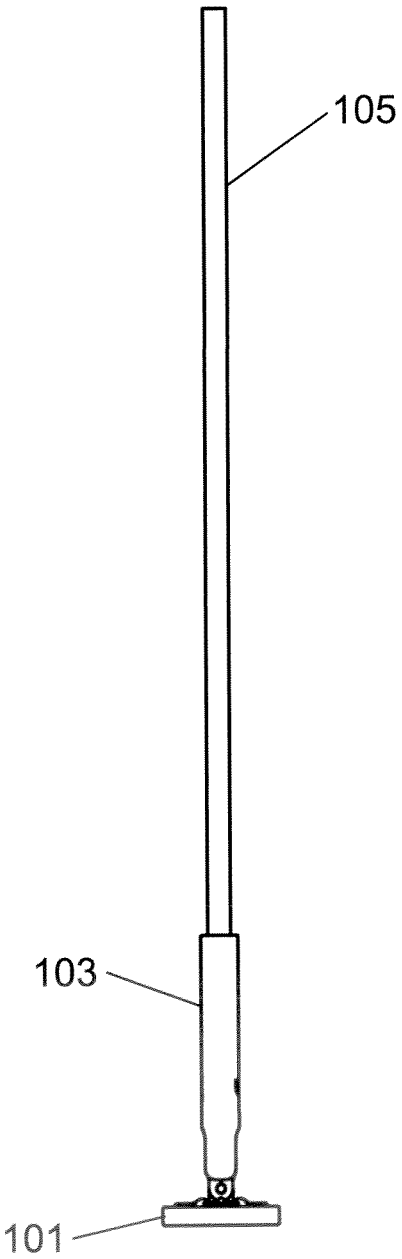
FIG. 6 is a rotated plan view of the butterfly duster.
Figure 7:
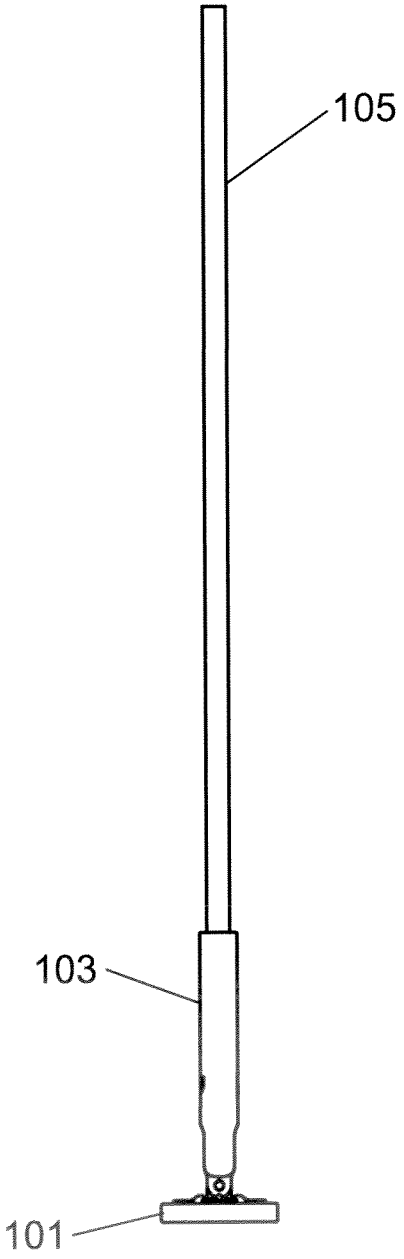
FIG. 7 is an opposite side rotated plan view of the butterfly duster.

FIG. 6 is a rotated plan view of the butterfly duster and FIG. 7 is an opposite side rotated plan view of the butterfly duster showing side views of the butterfly duster.

Figure 8:
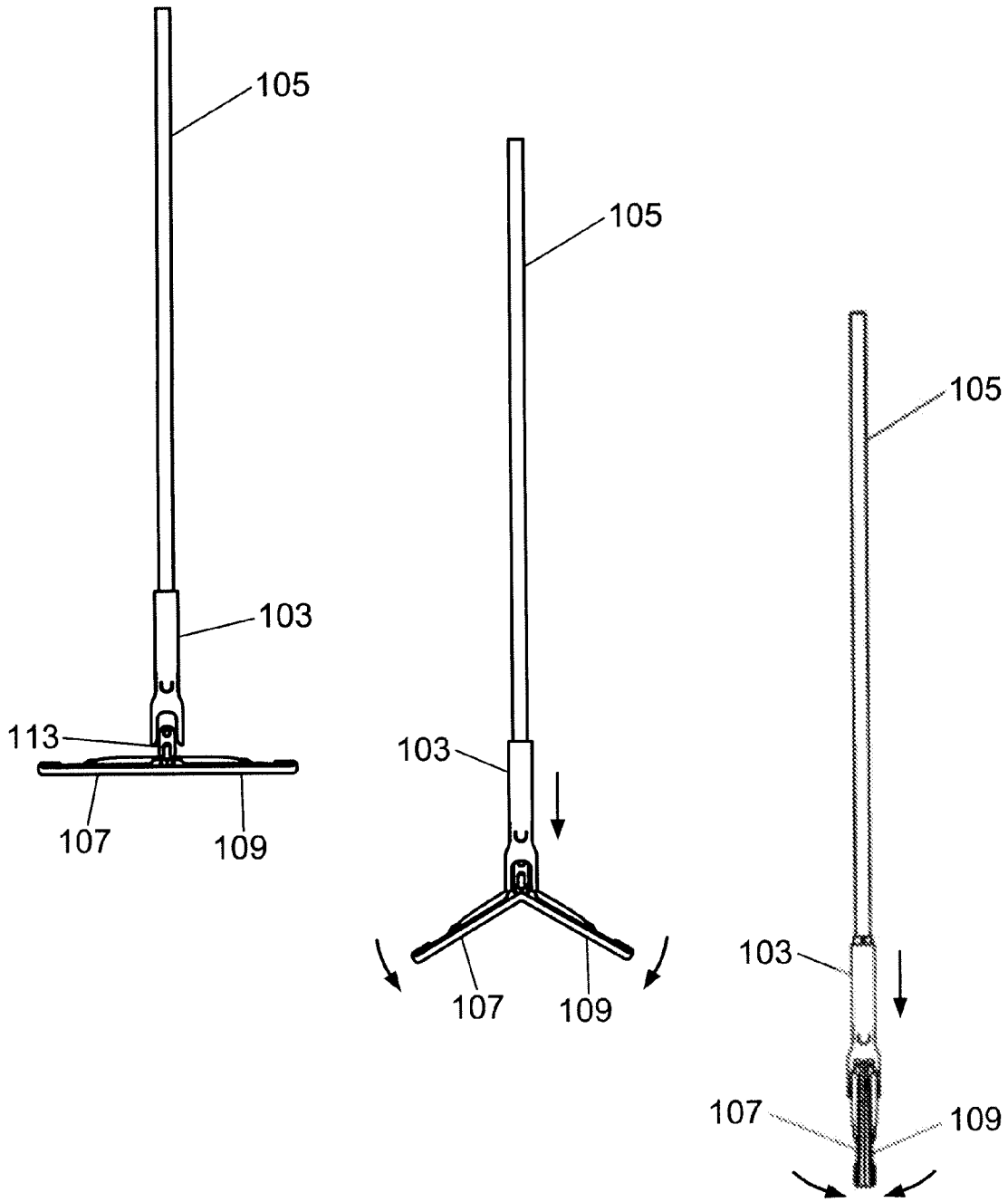
FIG. 8 depicts the butterfly duster in use.

Now turning to FIG. 8, the butterfly duster is depicted in use. To close the wings 107 and 109 of the butterfly duster, the fork actuator 103 is grasped and slid downward in the direction of the straight arrow in FIG. 8, center drawing. As the fork actuator 103 is moved downward toward the first wing 107 and the second wing 109, the wings fold together as indicated by the curved arrows, and with the fork actuator 103 in a completely extended downward position, the wings 107 and 109 become closed, with their cleaning surfaces in contact with each other. This closed position may be used for convenient storage of the butterfly duster, movement of the butterfly duster with trapped dust, dirt and debris within, and also for other cleaning applications that involve other than a planar surface to be cleaned. To open the butterfly duster wings, an opposite process is used. The fork actuator 103 is moved upward and away from the first wing 107 and the second wing 109, and the wings open so that they are generally perpendicular to the pole 105.

Figure 9:
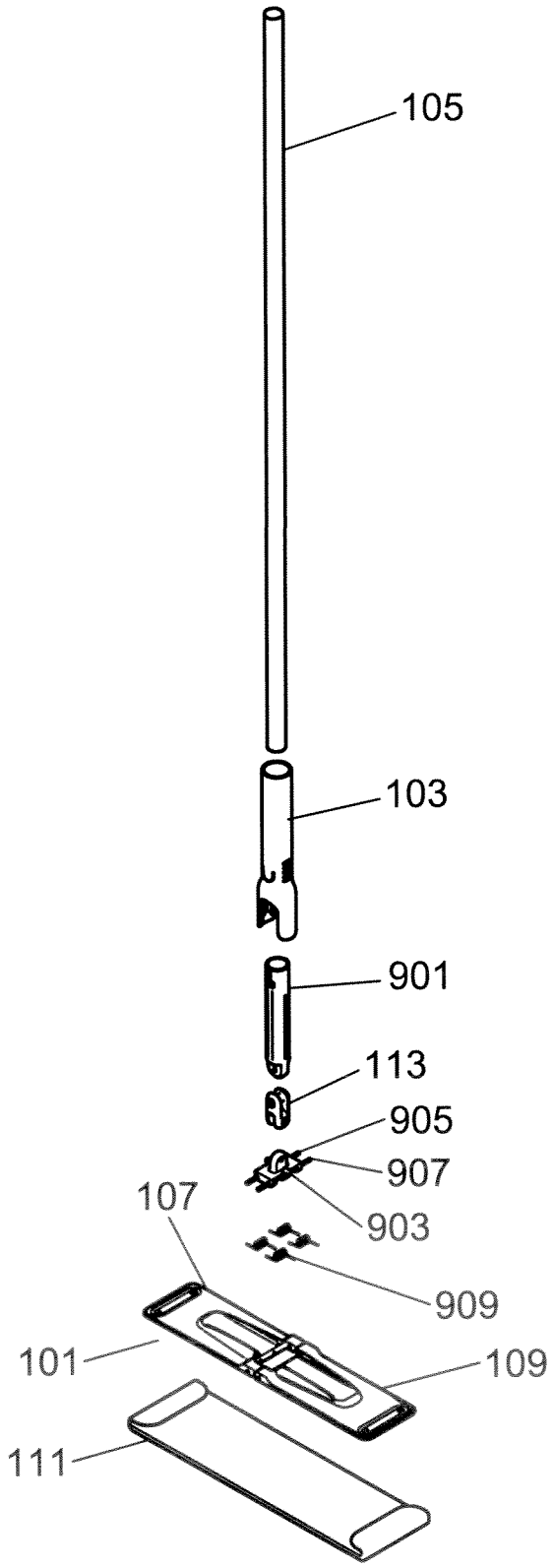
FIG. 9 is an exploded view of the butterfly duster.

FIG. 9 is an exploded view of the butterfly duster 100 showing the various components that make up the butterfly duster. A duster head 101 comprising a first wing 107 and a second wing 109 can be seen. Connecting the two wings is a wing hinge 903 where each wing is connected to the wing hinge 903 by way of a first wing pin 905 and a second wing pin 907. The wing pins are placed through the wing hinge 903 and also through holes in each wing to create a pivotal hinge where each wing can move by rotating along the axis of each respective pin. The pins may be, for example, a metal such as a stainless steel. A slide coupling 901 is hingably coupled to the wing hinge with a universal joint 113. The slide coupling 901 connects the pole 105 to the universal joint 113 and in turn to the duster head 101. The slide coupling 901 also provides a structure for the fork actuator 103 to ride upon. The fork actuator 103 is generally hollow and the slide coupling 901 is disposed within the hollow inner portion of the fork actuator 103. Also depicted in FIG. 9 are springs 909 that are mechanically coupled to the wing hinge for ease of returning the wings of the duster head to a planar configuration. The springs 909 may be made from steel, brass, a stainless steel, or the like, and may have tabs or other protrusions to allow coupling of the wing hinge 903 to each wing 107 and 109.

Figure 10A:
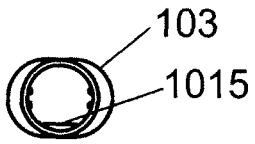
FIGS. 10A-10E are various views of the fork actuator.
Figure 10B:
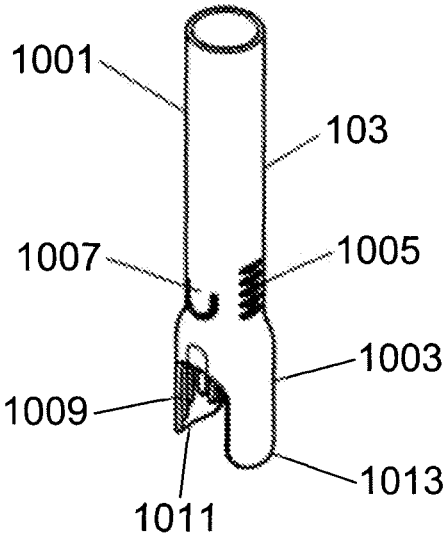
Figure 10C:
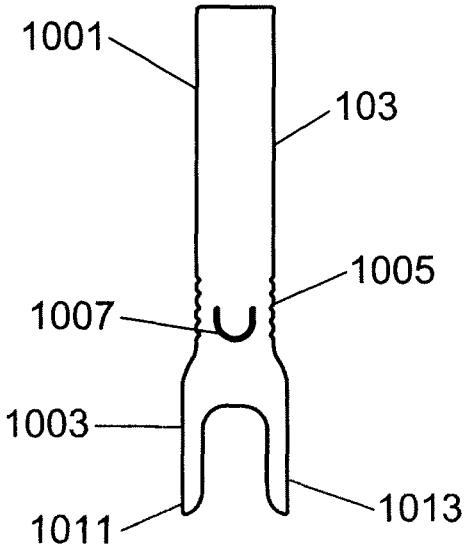
Figure 10D:
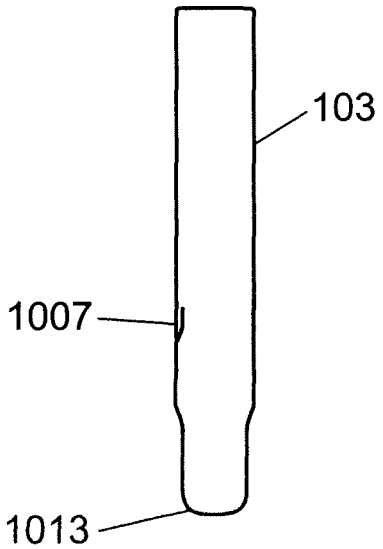
Figure 10E:
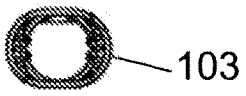
Figure 11A:
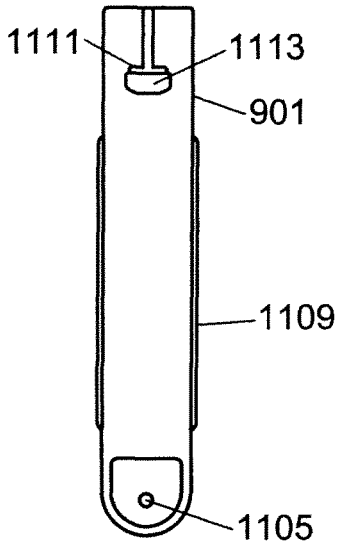
FIGS. 11A-11F are various views of the slide coupling.
Figure 11B:
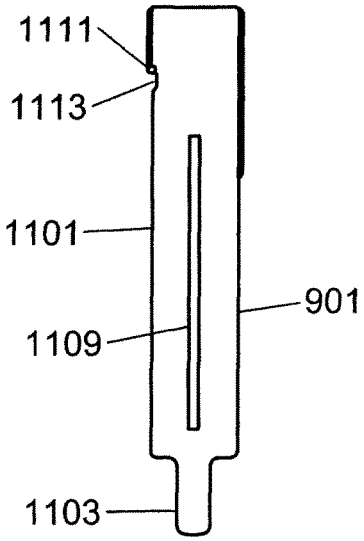
Figure 11C:
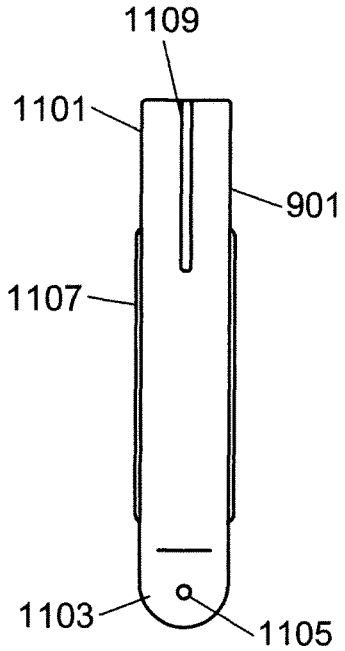
Figure 11D:
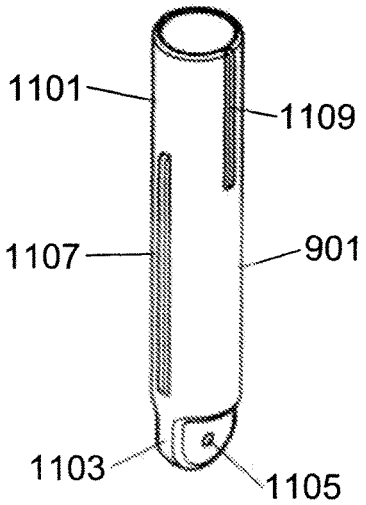
Figure 11E:
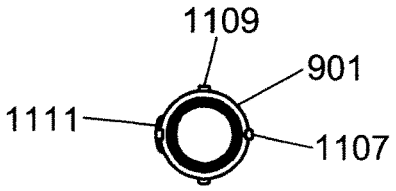
Figure 11F:
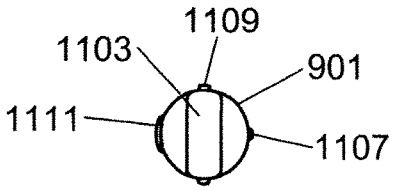
Figure 12A:
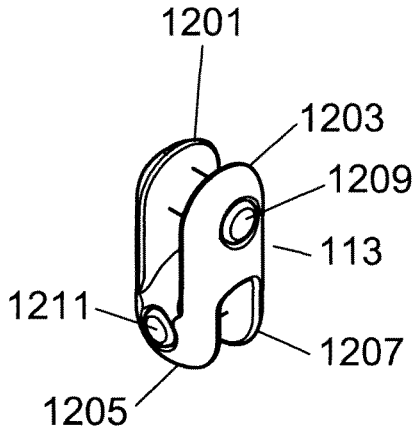
FIGS. 12A-12E are various views of the universal joint.
Figure 12B:
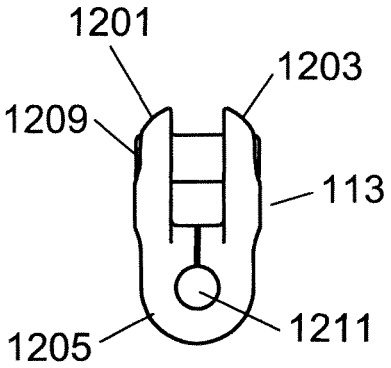
Figure 12C:
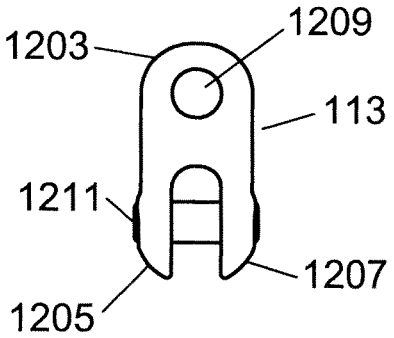
Figure 12D:
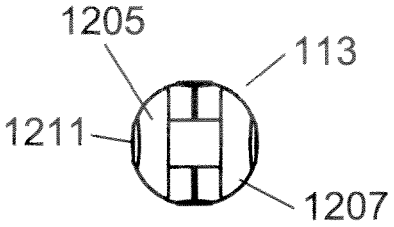
Figure 12E:
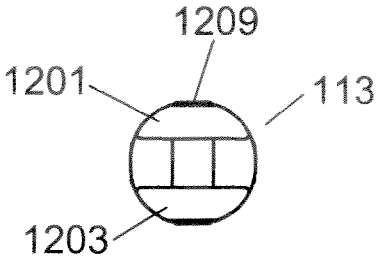
Figure 13A:
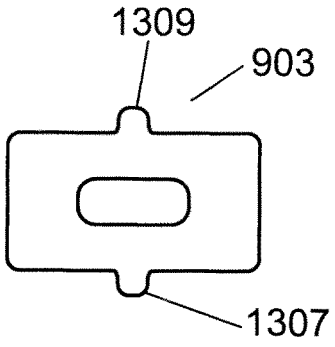
FIGS. 13A-13E are various views of the wing hinge.
Figure 13B:
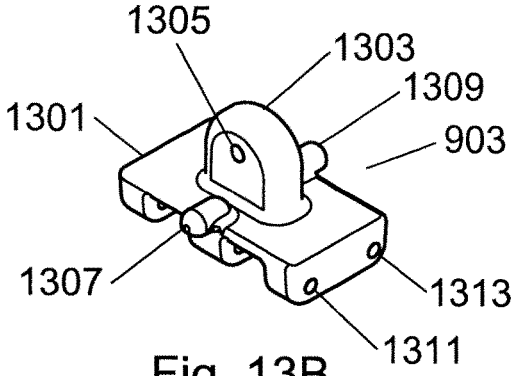
Figure 13C:
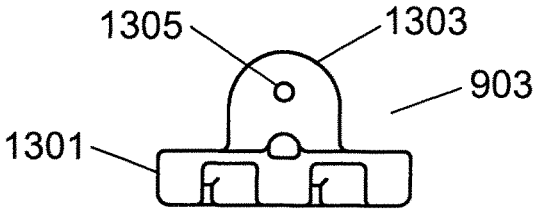
Figure 13D:
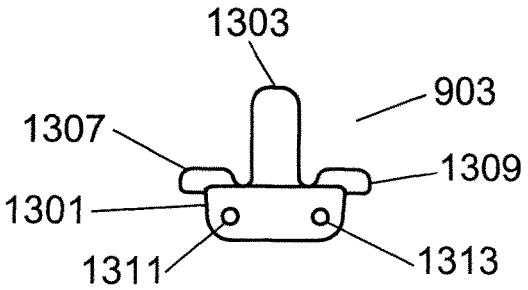
Figure 13E:
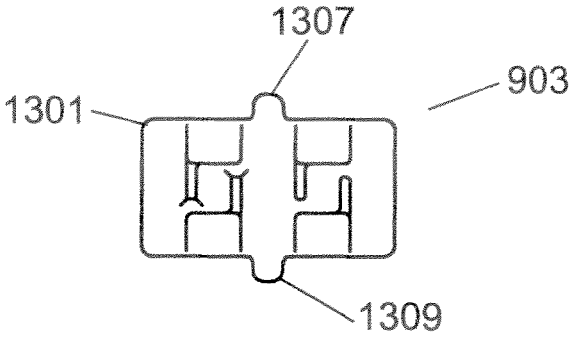
Figure 14A:
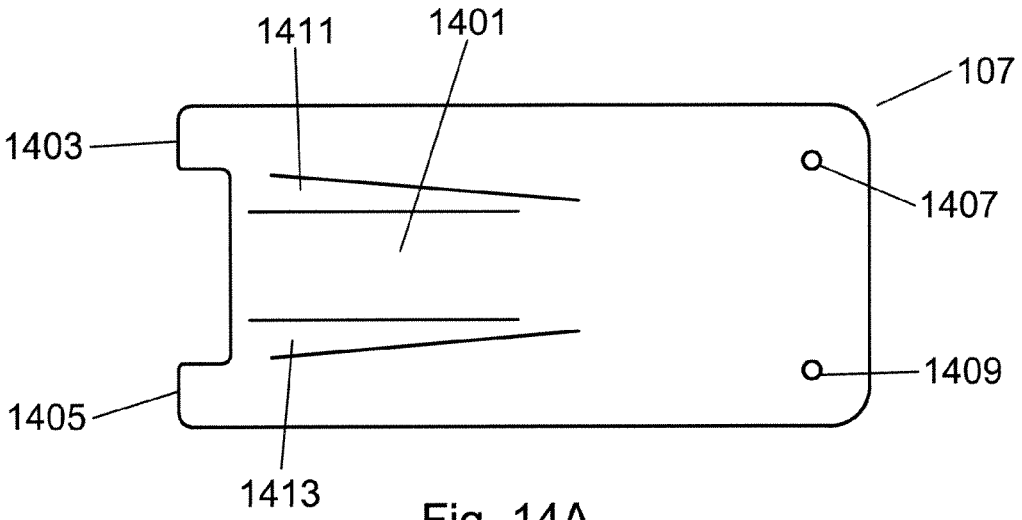
FIGS. 14A-14F are various views of the first wing.
Figure 14B:
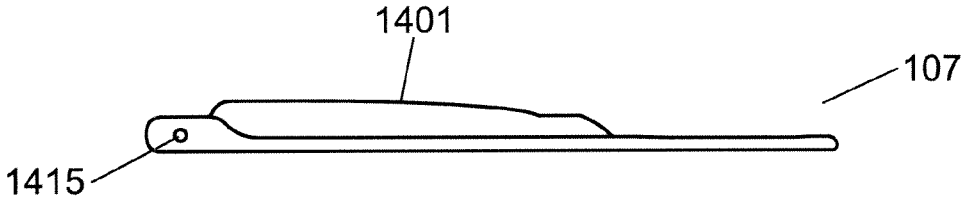
Figure 14C:
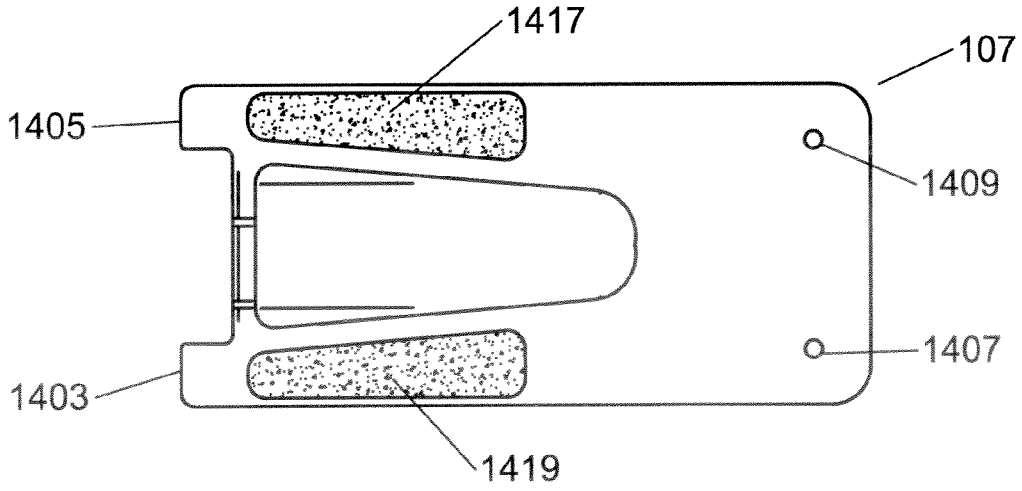
Figure 14D:
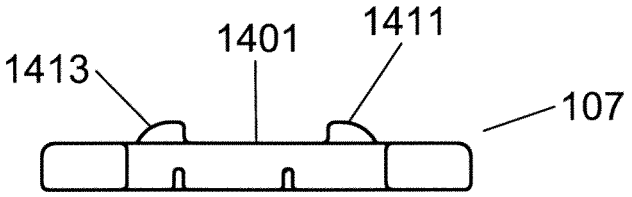
Figure 14E:
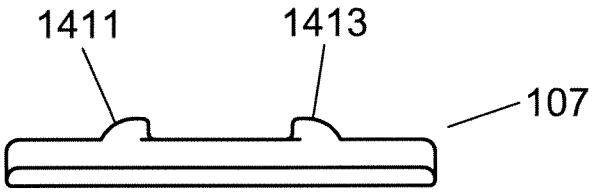
Figure 14F:
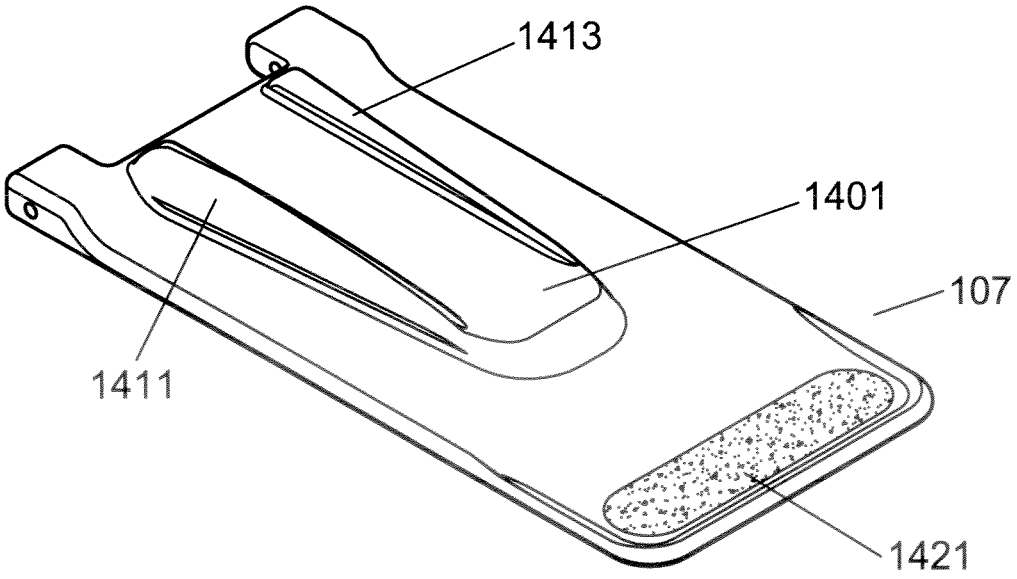
Figure 15A:
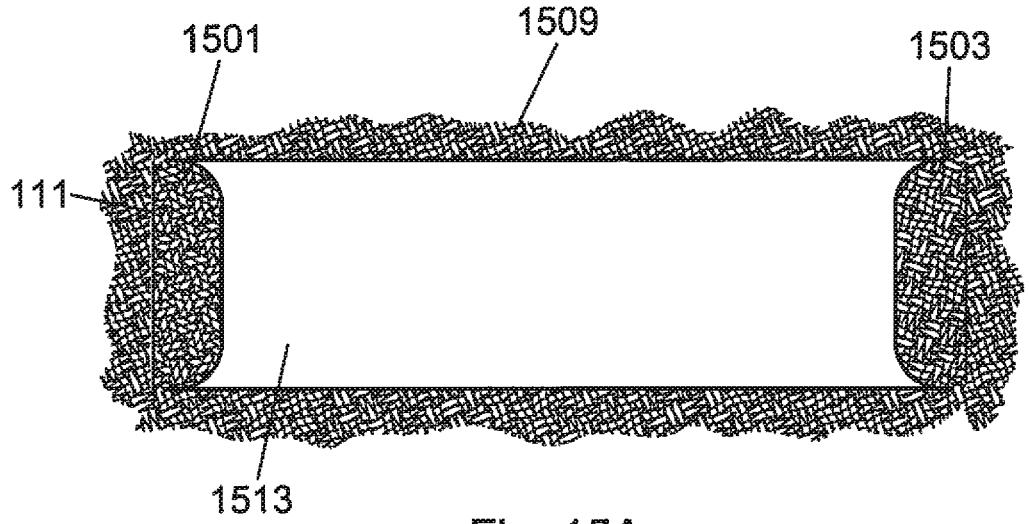
FIGS. 15A-15E are various views of the cleaning sleeve.
Figure 15B:
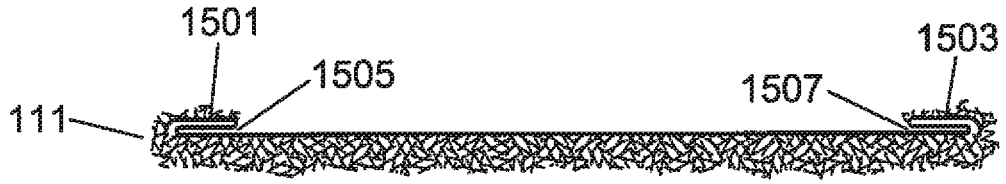
Figure 15C:
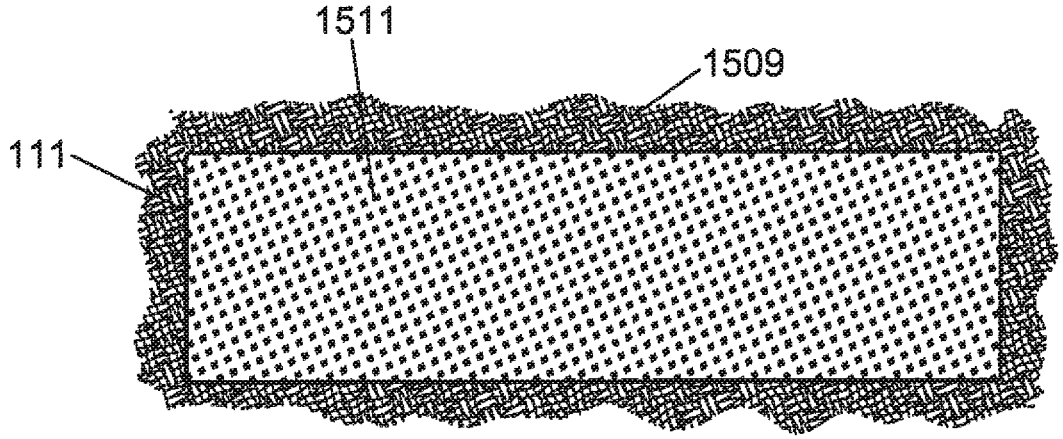
Figure 15D:
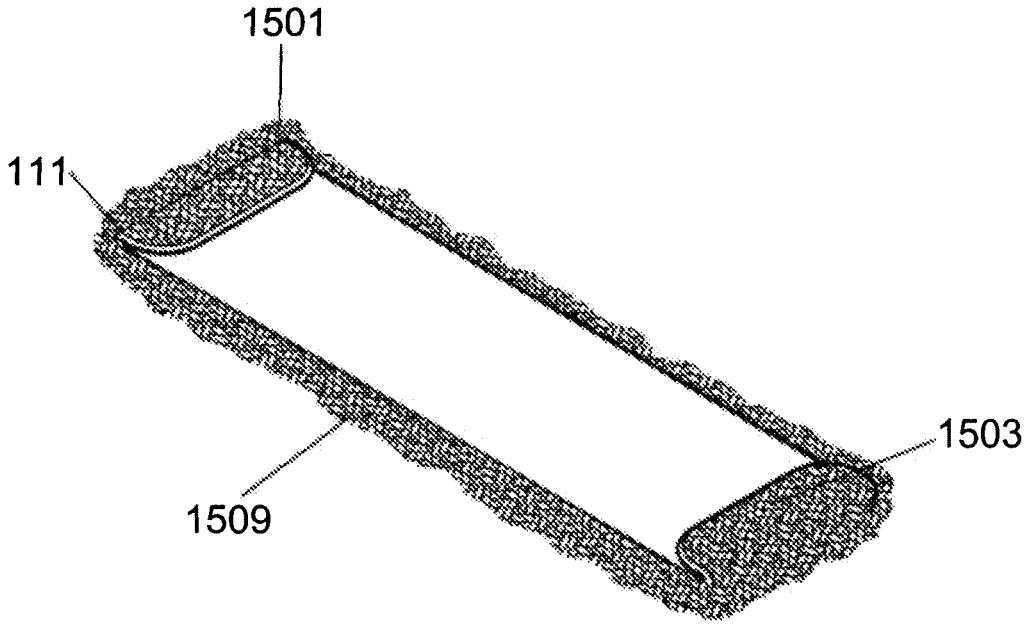
Figure 15E:
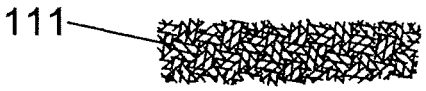

FIGS. 10A-10E are various views of the fork actuator 103. In FIG. 10A, an engagement tab 1015 can be seen. The engagement tab 1015 serves to prevent the fork actuator 103 from traveling too far up the slide coupling 901 and onto the pole 105. The engagement tab, in some embodiments of the present invention, is a semi-circular engagement tab cutout 1007 as seen in FIGS. 10B, 10C and 10D. The cutout creates a u-shaped piece that engages and interacts with a retainer on the slide coupling 901, as further described by way of FIG. 11. The fork actuator 103 is of a generally cylindrical shape wherein the diameter of the fork actuator cylinder varies between a larger forked cylinder portion 1003 and a smaller actuator cylinder portion 1001. The generally hollow fork actuator 103 comprises a first fork half 1011 and a second fork half 1013. In some embodiments of the present invention, grips 1005 are employed to assist in grasping the fork actuator 103. The grips 1005 may be linear, raised, dimpled, semi-circular, or contain other features and geometries to facilitate grasping the fork actuator 103. Inside the fork actuator 103, linear guide slots 1009 can be seen. The linear guide slots 1009 are on an inner surface of the fork actuator 103, and align with and receive a linear guide of the slide coupling 901 (See FIG. 11) to allow for alignment and proper folding of the wings of the duster head without the need for different materials between the wings and each gliding surface.

FIGS. 11A-11F are various views of the slide coupling 901. The slide coupling cylinder 1101 has a slide coupling joint 1103 for connection to the universal joint 113 (see FIG. 1) with a suitable pin, bolt, or the like. The slide coupling joint 1103 has a slide coupling hole 1105 to facilitate such connection. The slide coupling 901 has linear guides such as linear guides 1107 and 1109 on an outer surface that align with and are retained by the linear guide slots on the fork actuator, as seen in FIGS. 10A-10E. An engagement tab retainer 1111 and an engagement tab retainer slot 1113 can also be seen, and serve to interact with the engagement tab 1015 of the fork actuator 103, which limits travel of the fork actuator 103 on the slide coupling 901.

FIGS. 12A-12F are various views of the universal joint where the universal joint upper first half 1201 and the universal joint upper second half 1203 are coupled to the slide coupling 901 with a suitable pin 1209, bolt, or the like.

The universal joint lower first half 1205 and the universal joint lower second half 1207 provide a similar style coupling with a suitable pin 1211. bolt or the like to the wing hinge 903.

FIGS. 13A-13E are various views of the wing hinge. The wing hinge 903 has a first wing hinge post 1307 for halting travel of the first wing and a second wing hinge post 1309 for halting travel of the second wing. The posts may, in some embodiments of the present invention, be semi-cylindrical with a flat side where each wing rests in the open position. The wing hinge body 1301 may be rectangular in some embodiments of the present invention, and may have a wing hinge joint 1303 that has a wing coupling universal joint hole 1305 for coupling of the wing hinge 903 to the universal joint 113 (see FIG. 1). The wing hinge joint 1303 may, in some embodiments of the present invention, be semi-circular to allow for a range of motion with the universal joint 113. To retain each wing (see FIG. 9) to the wing hinge 903, the wing hinge body 1301 has a first wing pin hole 1311 for retention of the first wing 107 (see FIG. 9) by receiving the first wing pin 905. The wing hinge body 1301 also has a second wing pin hole 1313 for retention of the second wing 109 (see FIG. 9) by receiving the second wing pin 907.

FIGS. 14A-14F are various views of the first wing 107. The second wing 109 has a similar construction. Each wing further comprises a fork actuator gliding surface 1401 bounded by a first retention wall 1411 and a second retention wall 1413 in a configuration that allows each fork half of the fork actuator to glide along the surface of each wing in a controlled and linear manner without the need for different materials between the wings and each gliding surface. The retention walls are raised with respect to the fork actuator gliding surface to provide the containment and guidance of each fork half of the fork actuator when the butterfly mop is closed or opened. In some embodiments of the present invention, the fork actuator gliding surface 1401 is also raised with respect to the surface of the wing, with the retention walls raised even further. The retention walls may also have a tapered or triangular shape. To attach the wing hinge 903 to each wing, a first retention ear 1403 and a second retention ear 1405 are provided as part of each wing, and have a retention ear wing pin hole 1415 for placement of a wing pin therethrough. In some embodiments of the present invention, a first hole 1407 and a second hole 1409 are provided on each wing to receive a snap that retains the cleaning sleeve 111. Other fastening techniques may also be employed, such as hook and loop fasteners, T fasteners, magnets, tape, and the like. On the bottom surface of each wing, retention pads such as the first retention pad 1417, the second retention pad 1419 and the third retention pad 1421 may be used to further retain the cleaning sleeve 111. The retention pads may be adhesive, hook and loop fasteners, T fasteners, magnets, or the like.

FIGS. 15A-15E are various views of the cleaning sleeve 111. In use, the cleaning sleeve 111 is attached to the duster head 101 (see FIG. 9). The cleaning sleeve 111 may be made from a natural or synthetic fiber, for example, a polypropylene or polyester yarn or fiber. Various attachment techniques may be employed to fasten the cleaning sleeve 111 to the duster head 101 (see FIG. 1). For example, a first retention flap 1501 and a second retention flap 1503 attach over the end of each wing and are fastened to the top of each wing with fasteners such as snap fasteners, hook and loop fasteners, tape, adhesive, magnets, or the like. In some embodiments of the present invention, a retention flap slot such as the first retention flap slot 1505 and the second retention flap slot 1507 are molded or otherwise formed in each wing to receive and retain a portion of the retention flap. In some embodiments of the present invention, the cleaning sleeve 111 has a generally planar cleaning surface and a perimeter for attachment to the duster head 101 (see FIG. 1).

In some embodiments of the present invention, the generally planar cleaning surface of the cleaning sleeve 111 comprises short cleaning fibers 1511 and the perimeter of the cleaning sleeve comprises fibers 1509 that are longer than the fibers of the generally planar cleaning surface. In some embodiments of the present invention, the fibers are microfibers. Further, in some embodiments of the present invention, the cleaning sleeve 111 comprises a plastic core 1513.

The cleaning sleeve 111 for the butterfly duster 100 comprises a generally planar cleaning surface having a rectangular shape with a first width dimension and a second width dimension, a first length dimension and a second length dimension, and a perimeter; fibers attached to the generally planar cleaning surface; a first retention flap along the first width dimension of the cleaning surface and forming a first retention flap slot; and a second retention flap along the second width dimension of the cleaning surface and forming a second retention flap slot.

Figure 16:
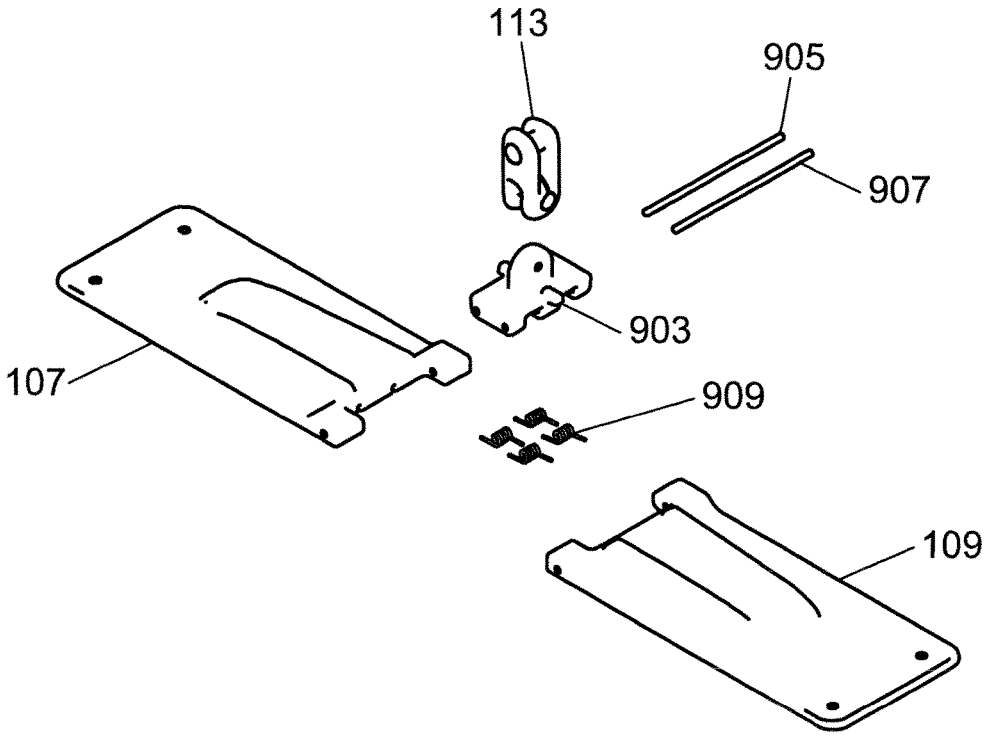
FIG. 16 is an exploded view of the duster head.

Lastly, FIG. 16 is an exploded view of the duster head 101 showing how the wing hinge 903 and the wings 107 and 109 are hingably attached with pins or with a similar hinge arrangement. The springs 909 and their retention slots can be clearly seen.

It is, therefore, apparent that there has been provided, in accordance with the various objects of the present invention, a butterfly duster. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of this specification, claims and the attached drawings.

What is claimed is:

1. A butterfly duster comprising:

a duster head comprising a first wing and a second wing;

a wing hinge comprising a wing hinge body, a wing hinge joint and at least one wing hinge post for engaging with each wing of the duster head;

a cylindrical slide coupling hingably coupled to the wing hinge with a universal joint;

a generally hollow and cylindrical fork actuator comprising an elongate cylindrical portion having a first fork half and a second fork half extending from an end of the cylindrical portion; wherein the cylindrical slide coupling is disposed within the cylindrical fork actuator and wherein each fork half is arcuate such that they define a portion of a cylinder arranged coaxially about the longitudinal axis of the cylindrical portion; and wherein each wing further comprises a fork actuator gliding surface bounded by a first retention wall and a second retention wall in a configuration that allows each fork half of the cylindrical fork actuator to glide along the surface of each wing in a controlled and linear manner without the need for different materials between the wings and each gliding surface.

2. The butterfly duster of claim 1, wherein the slide coupling further comprises at least one linear guide on an outer surface and the fork actuator comprises at least one linear guide slot on an inner surface that aligns with and receives the linear guide of the slide coupling to allow for alignment and proper folding of the wings of the duster head without the need for different materials between the wings and each gliding surface.

3. The butterfly duster of claim 1, further comprising a first wing pin for retention of the first wing to the wing hinge and a second wing pin for retention of the second wing to the wing hinge.

4. The butterfly duster of claim 3, wherein the wing hinge further comprises a first wing pin hole for receiving the first wing pin and a second wing pin hole for receiving the second wing pin.

5. The butterfly duster of claim 1, further comprising springs mechanically coupled to the wing hinge for ease of returning the wings of the duster head to a planar configuration.

6. The butterfly duster of claim 1, further comprising a pole coupled to the slide coupling.

7. The butterfly duster of claim 1, wherein the diameter of the fork actuator cylinder varies between a larger forked cylinder portion and a smaller actuator cylinder portion.

8. The butterfly duster of claim 1, wherein the fork actuator further comprises an engagement tab cutout that forms an engagement tab for interaction with the slide coupling.

9. The butterfly duster of claim 8, wherein the engagement tab cutout is semi-circular.

10. The butterfly duster of claim 8, wherein the slide coupling further comprises an engagement tab retainer slot for interaction with the engagement tab of the fork actuator.

11. The butterfly duster of claim 8, wherein the slide coupling further comprises an engagement tab retainer slot and an engagement tab retainer for interaction with the engagement tab of the fork actuator.

12. The butterfly duster of claim 1, wherein the wing hinge further comprises a first wing hinge post for halting travel of the first wing and a second wing hinge post for halting travel of the second wing.

13. The butterfly duster of claim 1, wherein each wing further comprises at least one fastener for retention of a cleaning sleeve.

14. The butterfly duster of claim 13, wherein the at least one fastener comprises a hook and loop fastener.

15. The butterfly duster of claim 1, further comprising a cleaning sleeve having a generally planar cleaning surface and a perimeter for attachment to the duster head.

16. The butterfly duster of claim 15, wherein the generally planar cleaning surface of the cleaning sleeve comprises fibers and the perimeter of the cleaning sleeve comprises fibers that are longer than the fibers of the generally planar cleaning surface.

17. The butterfly duster of claim 1, further comprising a cleaning sleeve, the cleaning sleeve comprising:

a generally planar cleaning surface having a rectangular shape with a first width dimension and a second width dimension, a first length dimension and a second length dimension, and a perimeter, fibers attached to the generally planar cleaning surface;

a first retention flap along the first width dimension of the cleaning surface and forming a first retention flap slot; and a second retention flap along the second width dimension of the cleaning surface and forming a second retention flap slot.

18. The butterfly duster of claim 17, wherein the cleaning sleeve further comprises fibers along the perimeter of the cleaning surface that are longer than the fibers of the generally planar cleaning surface.

19. The butterfly duster of claim 17, wherein the cleaning sleeve further comprises a plastic core.

20. The butterfly duster of claim 17, wherein the fibers of the cleaning sleeve are microfibers.

* * * * *